US010724333B2

(12) United States Patent
Purkis

(10) Patent No.: US 10,724,333 B2
(45) Date of Patent: Jul. 28, 2020

(54) CHOKE

(71) Applicant: WEATHERFORD TECHNOLOGY HOLDINGS, LLC, Houston, TX (US)

(72) Inventor: Daniel Purkis, Peterhead (GB)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 16/529,704

(22) Filed: Aug. 1, 2019

(65) Prior Publication Data

US 2019/0353004 A1 Nov. 21, 2019

Related U.S. Application Data

(62) Division of application No. 14/896,568, filed as application No. PCT/GB2014/051763 on Jun. 9, 2014, now Pat. No. 10,428,621.

(30) Foreign Application Priority Data

Jun. 7, 2013 (GB) ..... 1310187.8

(51) Int. Cl.
*E21B 34/08* (2006.01)
*E21B 34/14* (2006.01)

(52) U.S. Cl.
CPC ..... *E21B 34/08* (2013.01); *E21B 34/14* (2013.01)

(58) Field of Classification Search
CPC ..... E21B 34/08; E21B 34/14
See application file for complete search history.

(56) References Cited

U.S. PATENT DOCUMENTS 5,971,604 A * 10/1999 Linga ..... B01F 15/0429 137/625.3
7,150,318 B2 * 12/2006 Freeman ..... E21B 34/14 166/255.1
8,434,515 B2 5/2013 Nilssen
2002/0157837 A1 * 10/2002 Bode ..... E21B 23/006 166/373
2003/0159832 A1 8/2003 Williamson
2006/0284134 A1 * 12/2006 Dwivedi ..... F16K 5/0428 251/208

(Continued)

FOREIGN PATENT DOCUMENTS

GB 2348226 A 9/2000
WO 2008156369 A1 12/2008

OTHER PUBLICATIONS

International Search Report dated Apr. 29, 2015 for PCT Patent Application No. PCT/GB2014/051763, 8 pages.

(Continued)

*Primary Examiner* — Matthew R Buck
(74) *Attorney, Agent, or Firm* — Smith IP Services, P.C.

(57) ABSTRACT

A choke controlling fluid flow in a well has a conduit with an inlet and an outlet, and a flow restrictor comprising first and second choke members, one of which rotates relative to the other to choke or promote flow. The first and second choke members are axially spaced from one another, and have mating faces that are optionally planar, and are axially stacked in the choke. The choke is operated by a shifting tool, which grips the inner surface of the rotating choke member, and rotates it relative to the other, in order to vary the flow.

16 Claims, 6 Drawing Sheets

(56) References Cited

U.S. PATENT DOCUMENTS

| | | | | |
|---|---|---|---|---|
| 2007/0257225 | A1* | 11/2007 | Dwivedi | F16K 5/0428 251/356 |
| 2008/0314590 | A1 | 12/2008 | Patel | |
| 2009/0065199 | A1 | 3/2009 | Patel et al. | |
| 2009/0294124 | A1* | 12/2009 | Patel | E21B 23/02 166/255.2 |

OTHER PUBLICATIONS

International Written Opinion dated Apr. 29, 2015 for PCT Patent Application No. PCT/GB2014/051763, 13 pages.
European Examination Report dated Jan. 17, 2018 for EP Patent Application No. 17188254.1, 8 pages.
Office Action dated May 24, 2018 for U.S. Appl. No. 14/896,568, 26 pages.
Office Action dated Nov. 14, 2018 for U.S. Appl. No. 14/896,568, 14 pages.
Office Action dated Feb. 27, 2019 for U.S. Appl. No. 14/896,568, 6 pages.

* cited by examiner

CHOKE

CROSS-REFERENCE TO RELATED APPLICATIONS

This application is a division of prior application Ser. No. 14/896,568 filed on 23 May 2017, which is a national stage of International Application No. PCT/GB14/051763 filed 9 Jun. 2014, which claims priority to United Kingdom Application No. GB 1310187.8 filed 7 Jun. 2013. The entire disclosures of these prior applications are incorporated herein by this reference.

The present invention relates to a choke for a well, particularly a downhole choke suitable for incorporation into a completion system in an oil or gas well. In particular examples, the present invention can be used in a downhole choke which controls fluid ingress into a production conduit for recovery of the production fluids from a reservoir of the well. Some examples are suitable for subsea wells, and some examples are suitable for both subsea and land wells. Some examples are particularly suitable for deviated wells, particularly multi-lateral deviated wells, having more than one deviated branch.

BACKGROUND TO THE INVENTION

The wellbore of an oil or gas well serves as a conduit for recovery of the valuable hydrocarbon-rich production fluids from the reservoir to the surface. The wellbore passes through the reservoir, and is optionally divided into separate zones corresponding to different zones of the reservoir that may have different characteristics. It is particularly beneficial to choke back production fluids from some zones and promote production from others, because production is inconsistent across the different reservoir zones. For example, some zones of the well generally produce higher proportions of valuable hydrocarbon-rich production fluids than others. Some zones of the well generally produce higher proportions of less desirable components such as water, waxes and corrosive or harmful gases such as hydrogen sulphide. It is useful to be able to limit the production of fluids from the less productive zones, so that the overall proportion of valuable hydrocarbon-rich production fluids that flow from the well is increased, and the proportion of undesirable fluids that are recovered to the surface is minimised. In addition, the proportion of desirable and undesirable components of the production fluid may change over the lifetime of the well, as the available hydrocarbon-rich fluids in the reservoir are depleted, and the ratio of water: hydrocarbon-rich fluids increases. Hence, it is often useful to be able to adjust the flow of fluids from different zones during the life of the well.

A completion string can be inserted into the production zones of the wellbore to control the flow of fluids within each zone. The completion string can optionally incorporate at least one choke in each zone, which can be closed to choke back the flow of production fluids from unproductive zones of the well, and which, in more productive zones, can be opened to promote the flow of hydrocarbon-rich fluids into the wellbore for recovery to the surface. Adjacent zones are optionally isolated from one another by packers which occlude the annulus between the completion string and the inner surface of the wellbore (e.g. the open hole or casing), so that in unproductive zones, when the choke controlling fluid flow into the completion string is closed, the lower value water-rich production fluids are at least partially excluded from the wellbore. The completion string can optionally also incorporate one or more screens to filter out particulate materials such as sand which is generally entrained in the production fluids flowing into the wellbore from the formation. Optionally the completion string conveys the production fluids into the production tubing for recovery from the well.

U.S. Pat. No. 8,434,515 discloses a sleeve valve which is useful for understanding the invention.

SUMMARY OF THE INVENTION

According to the present invention there is provided a choke adapted for downhole use in an oil or gas well to control the flow of fluids in a reservoir, the choke having an axis, and comprising:

a conduit with a bore;

a first opening allowing fluid communication between the outside of the conduit and the choke;

a second opening allowing fluid communication between the choke and the bore of the conduit;

a flow path connecting the first and second openings;

a flow restrictor that is selectively adjustable to change a cross sectional area of the flow path through the choke, the flow restrictor comprising first and second choke members, each incorporating a portion of the flow path;

wherein at least one of the first and second choke members is rotatably mounted to rotate relative to the other to move the flow paths of the first and second choke members relative to one another to change a cross-sectional area of the flow path;

wherein each choke member has a mating face that engages a cooperating mating face of the other choke member, and wherein each mating face has an aperture that moves relative to the aperture on the mating face of the other choke member as the at least one choke member rotates relative to the other choke member, and wherein the first and second choke members are axially spaced from one another.

Optionally the first and second openings are axially spaced from one another.

Optionally the choke is a downhole choke, and is used to control the flow of production fluids in the reservoir of the oil and gas well, optionally fluids flowing from the reservoir into the bore of the well.

Optionally flow of the fluids through the choke between the first and second openings flows through the choke members.

Optionally the choke incorporates a piston device exposed to fluid pressure. Optionally fluid pressure acting on the piston device is arranged to control a force acting on the choke members.

Optionally the choke incorporates at least one seal device, which can optionally be disposed on the rotating choke member. Optionally, the choke device can have a first seal device and a second seal device. Optionally the seal devices can be disposed on the piston device. At least one of the seal devices is optionally exposed to fluid pressure. In some embodiments with more than one seal device, different seal devices optionally seal across different piston areas.

Optionally the choke incorporates a resilient device. Optionally the resilient device is arranged to urge the choke members together. Optionally the resilient device is arranged to urge the mating faces of the choke members into contact. Optionally a washer or other spacer is provided between the resilient device and the choke members. Optionally, the resilient device urges the rotatable choke member against the fixed choke member. Optionally the choke has a detent to control the relative rotational positions of the choke members. Optionally the detent maintains the relative rotational positions of the choke members, and can optionally comprise a catch. Optionally the detent is selectively releasable to permit the relative rotation of the choke when the detent is released. Optionally one face of the washer or other spacer that engages the rotatable choke member has a detent to hold the rotational position of the rotatable choke member in a fixed position. Optionally the detent comprises a ratchet device or similar indexing profile, which permits relative rotation of the rotatable choke member in a predictable manner, for example in predictable increments according to the profile of the ratchet face. Optionally the ratchet mechanism or other indexing system provided by the resilient device and the spacer maintains the rotational configuration of the rotatable choke member in the absence of any other force, but is optionally easily overcome when adjustment of the choke is required.

Optionally each mating face has at least one aperture.

Optionally the choke members are pressed together, and optionally the piston and/or the resilient device controls the force pressing the choke members together. Optionally the choke members are pressed together by differential fluid pressure across the choke members. Optionally the choke members are biased together by a relatively weak force applied by the resilient device to bring the mating faces of the choke members into contact, and optionally to form at least an initial seal between them, and optionally the piston area is selected such that the differential fluid pressure applies a sealing force urging the choke members together below a threshold maximum to restrict sticking of the choke. In some examples, the resilient device controls the force urging the choke members together, and the strength and other parameters of the resilient device can be selected accordingly. Differential effects can be designed to cancel out by careful control of the relative piston areas for the anticipated operating conditions. Optionally the forces across the choke members are at least partially equalized by the piston device. For example, in the closed position, differential pressure across the choke members will tend to produce a clamping force between the two sealing faces. Higher clamping forces are beneficial as corresponding stress increases assist with sealing at high pressure. High pressure sealing can also be improved by reducing the contact area, and optionally the choke members can incorporate a slightly raised sealing edge around the periphery of one or both of the openings, to provide a smaller surface area for the seal, in order to increase the sealing efficiency.

Large sealing forces are beneficial for the face seal, but can sometimes be undesirable when attempting to rotate the choke. In some examples, the clamping force urging the choke members together can be hydraulically balanced by the differential area between the two seal elements. If required, the effect of differential fluid pressure can be reduced to zero. To achieve this, the differential area of the piston (i.e. the difference in surface area between the seals on the rotating choke member) is controlled by setting the sealed diameters on the rotating choke member at chosen value. Also, the cross-sectional surface area of the flow path though the choke members is optionally manipulated along with the surface area of the sealing face between the choke members. Some or all of these variables can optionally be tuned by the skilled person to reduce or cancel out the differential fluid pressure acting on the choke to urge the choke members together. In some example, the force can be reduced to zero, and in some other examples, the force can be maintained but can be reduced to a controlled range which does not substantially resist relative rotation of the choke members when the choke is to be opened. In examples where the forces generated by differential fluid pressure acting on the choke members is balanced into controlled ranges, the seal force urging the choke members together is generated by the resilient device, optionally a Belleville spring stack, which can be pre-loaded in compression. This seal force is advantageously dependent on the pre-load and the strength of the resilient device, and is relatively independent of fluid pressure differential effects, as a result of the manipulation of the factors outlined above.

Optionally the mating surface of at least one and optionally both of the first and second choke members is at least partially planar, optionally in the form of a generally flat disc, optionally with ridges or other formations extending from the mating face. Optionally the mating faces of the choke members can remain in contact during relative rotation.

Optionally at least one aperture on the mating face of at least one choke member is arranged on an arc. Optionally each choke member has an aperture arranged on an arc, and optionally the arcs on the respective choke members at least partially intersect. Optionally, a single continuous aperture can take the form of a single continuous arc, or, in certain aspects, a number of apertures can be arranged on the arc. Optionally, a single aperture arranged in an arc can be provided with one or more supporting webs which extend from one side of the aperture to the other, and which resists changes in the dimensions of the aperture. Optionally, the arc extends for less than 180° around the mating face of at least one choke member. Optionally, the choke members can be arranged in contact with one another such that the apertures on each mating face are out of register with one another, and do not align, so that fluids cannot flow directly from one aperture to the other. Optionally the area of overlap between the apertures on the mating faces of each choke member gradually changes (e.g. increases or decreases) during relative rotation of the choke members.

In certain examples, "off" or "closed" positions on the choke members can be disposed between open positions on the arc. For example, by using a series of apertures with different sizes spaced around the arc, and by intercalating closed sections in between them, the choke members can achieve an alternating "open" and "closed" arrangement, which opens to different extents in different rotational positions. For example, the sequence of apertures in the fixed choke member can optionally be: "closed-2% open-closed-5% open-closed-10% open . . . etc." Optionally choke can be operated to pass straight through the closed positions between the apertures in the event that the operator wishes to move from the 2% position to the 5% position. Optionally the series of apertures can be provided in the fixed choke member. Optionally this arrangement of a series of apertures on the fixed member can be combined with a single arcuate aperture on the rotatable member, which can optionally uncover sequentially more of the apertures as it rotates.

Optionally the choke can have erosion-resistant facing on at least one flow path within the choke, for example on at least one mating face of a choke member. The erosion-resistant facing can be provided in different ways known to the skilled person. For example, the erosion-resistant facing can comprise a hardened coating applied to a component of the choke, and/or a portion of the surface of the component can be treated to induce erosion resistance, and/or a choke component can be formed from erosion-resistant material. Other options, such as erosion-resistant inserts or facings that are bonded to the component can also be used.

Optionally the erosion-resistant facing is provided mainly on the fixed choke member, optionally on the mating face, which is likely to be more susceptible to erosion than the rotatable choke member.

Optionally more than one aperture is provided. Optionally two or more apertures are arranged on the same arc, optionally aligned with one another on the arc. Optionally, respective apertures can be arranged on different arcs, optionally concentric arcs, which optionally have a different radius. Hence, one arc with a first aperture can be positioned at a first radius, and a second arc with a second aperture can be positioned at a second radius on the mating faces. The radius of the arc can be consistent or variable.

Optionally, the cross-sectional area of the aperture(s) on the arc increases in one arcuate direction and decreases in the other direction. Accordingly, as the choke member rotates, the intersecting cross-sectional area of the aperture(s) increases or decreases in accordance with the rate of rotation and the change in the cross-sectional areas. The increase or decrease in the overlapping areas can be linear so that the rate of change in area is constant during rotation, or non-linear, i.e. when the rate of change varies during rotation.

Any subject matter described in this specification can be combined with any other subject matter in the specification to form a novel combination.

The present invention also provides a choke adapted for downhole use in an oil or gas well to control the flow of fluid in a the well, the choke having:

a conduit with a bore;

a first opening allowing fluid communication between the outside of the conduit and the choke;

a second opening allowing fluid communication between the choke and the bore of the conduit;

a flow path connecting the first and second openings;

a flow restrictor that is selectively adjustable to change a cross sectional area of the flow path through the choke, the flow restrictor comprising first and second choke members, each incorporating a portion of the flow path;

wherein at least one of the first and second choke members is rotatable relative to the other to change a cross sectional area of the flow path;

wherein each choke member has a mating face that engages a cooperating mating face of the other choke member, and wherein each mating face has at least one aperture, wherein at least one of the apertures on the mating faces is movable relative to at least one aperture on the mating face of the other choke member as the at least one choke member rotates relative to the other; and wherein at least one aperture on the mating face of at least one choke member is arranged on an arc extending for less than 180° around the mating face of each choke member, and wherein rotation of at least one choke member relative to the other changes the area of the apertures that are aligned on the mating faces.

Optionally the relative rotation of the choke members moves the flow paths of the first and second choke members in and out of register with one another to change the cross sectional area of the flow path through the choke, thereby changing the fluid flow capacity of the flow path through the choke.

Optionally the first aperture comprises an inlet allowing fluid flow into the choke from outside the conduit. Optionally the second aperture comprises an outlet allowing fluid flow from the choke into the bore of the conduit. Optionally, flow of the fluids through the choke between the inlet and the outlet flows through the choke members.

Optionally, the maximum cross-sectional area of overlap of the apertures in the mating faces is within 10% of the cross-sectional area between the first and second sealing devices on the piston device. Optionally within 5%, and optionally the maximum cross-sectional areas of the overlapping apertures and the area between the sealing devices on the piston device are substantially the same. Within these ranges, the force applied to the choke members by any fluid pressure difference between the outside of the conduit and the inside of the conduit (e.g. between the first and second openings) is eliminated or is substantially reduced to manageable levels, and the force urging the mating faces together is more consistent at different pressures. Accordingly, at high pressure differentials, it is relatively straightforward to open the choke by rotating the choke members relative to one another without excessive force tending to urge the two choke members together, and resisting relative rotation. The force required to rotate the choke member and adjust the size of the overlap is therefore relatively predictable over a broad range of working pressures, and is more related to the spring force than to the fluid pressure differentials existing across the flow restrictor. Accordingly the spring force can be kept relatively low (e.g. 100 Nm or less) and the torque then needed to adjust the flow restrictor is then known to be a relatively predictable value above this (e.g. 200 Nm). The values here are given by way of example, and without intending limitation of the invention to these figures.

Optionally the choke has a longitudinal axis, and the apertures are optionally provided on axially adjacent (optionally axially abutting) mating faces, and optionally rotation of at least one of the choke members around the axis increases the overlap between the apertures as the choke member rotates in one direction, and decreases the overlap between the apertures as the choke member rotates in the other direction.

Optionally the flow path through the choke members has an axial portion that is parallel to the axis of the choke. Optionally the flow restrictor is in the axial portion. Optionally the flow path through the choke members changes the direction of fluid flow through the choke members. Optionally the flow path through the choke members has a radial component, optionally located at opposing ends of the flow path through the choke members.

Optionally the choke members form an axial stack, with their mating faces abutting one another and their central bores in alignment. Optionally at least one of the apertures is axially arranged in the wall of at least one and optionally each of the choke members and the rotation of the choke member(s) changes the overlap of the axial apertures, and leaves the central bores still in alignment with one another in different rotational positions. Optionally changes in the configuration can be can achieved simply by rotating the choke members to vary the overlap between the axial apertures, with no other changes being needed to the device. Flow paths optionally extend axially through the stack and optionally emerge through the mating faces, in axial alignment with one another through the stack, and it has been found that this allows the choke to retain high compressive axial strength while permitting large flow paths. The ID of the central bore can therefore also be maximised to accommodate larger flow paths through the bore of the choke, and more space for access for intervention in the central bore.

Optionally one of the choke members is fixed and the other choke member is rotatable relative to the fixed choke member. Optionally both choke members can be rotatable. Optionally at least the rotatable choke member is annular, having a generally cylindrical form. Optionally the first and second choke members are axially aligned with one another, with the mating faces at opposing axial ends, abutting one another. Optionally, each of the choke members has a cylindrical bore extending axially parallel to the axis of the choke, and optionally the bores of the choke members are concentric and in alignment. Optionally the bores of the choke members together make up the bore of the choke. Optionally the flow path on one of the choke members (for example, the rotatable choke member) connects the outer opening on the outer surface of the choke member with the axial aperture on the mating face. Optionally the flow path on the other choke member (for example, the fixed choke member) connects the axial aperture on the mating face with the inner opening on the inner surface of the choke member, which optionally communicates with the bore of the choke. Accordingly, fluid outside the bore of the choke can flow through the inlet on the outer surface of the choke, and can optionally flow axially through the flow path extending through the choke members, passing through the apertures in their mating faces in an axial direction, before passing through the outlet on the inner surface of the choke, from where it can flow into the bore, which is optionally in fluid communication with the production tubing of the well, for recovery of the production fluids to the surface. The axial flow paths through the choke maximise fluid recovery into the conduit as the axial pathways have lower resistance to fluid flow. Therefore, production fluids from formations with lower flow rates can be produced more efficiently.

Optionally the rotatable choke member incorporates the piston device, optionally having the first and second seal devices, which are optionally annular seals such as O-rings. Optionally the choke members are housed in a choke body with a bore, and the rotatable choke member is optionally sealed in the bore of the body, optionally by the first and second seal devices, which are optionally disposed between (and optionally seal between) the outer surface of the choke device and the inner surface of the body.

Optionally the inlet of the choke is located on an outer surface of the rotatable choke member. Optionally the outlet of the choke, with the opening into the bore of the conduit, is provided in the fixed choke member. Optionally the inlet and outlet comprise annular chambers extending circumferentially around the whole of the outer and inner surfaces of the first and second choke members, and optionally the apertures in the mating faces open into the chambers. Accordingly, rotating one of the choke members relative to the other, to bring the apertures in the mating faces into register with one another opens the flow path through the choke members to connect the annular chambers on opposite (e.g. outer and inner) faces of the choke.

In some examples, at least a portion of the choke can have enhanced erosion resistance. The enhanced erosion resistance is optionally provided on at least one of the components forming a part of the fluid pathway through the choke. In some examples, at least one of the choke members can have enhanced corrosion resistance, particularly, but not exclusively in the area of the aperture of the choke member, which can be coated, or treated or faced or provided with an insert to enhance its corrosion resistance. In some aspects, the mating faces of at least one of the choke members (optionally at least a part of the flow path through the choke members) can have bearing faces that are provided with coatings, facings, inserts or treatments etc. that enhance resistance to erosion from fluid flowing through the apertures, and/or that enhance rotation by, e.g. reducing friction between the mating faces as they rotate. In some examples at least one choke member (or at least a part thereof) could be made entirely out of an erosion resistant material. Optionally the movable choke member (or a portion thereof, for example a portion around the aperture) can be made from or can be treated with an erosion resistant material in this manner. Suitable materials for coating, facing, forming into components etc. include ceramic materials, stellite, tungsten carbide etc. Other bearing materials can be used. Optionally the bearing faces between the choke members can be polished or treated in some other way to enhance bearing properties. Optionally the mating faces can be ground and smooth to facilitate rotation while being pressed together.

In some aspects, the mating faces can incorporate protrusions, for example ridges, which optionally surround the apertures on each mating face, and which optionally present towards the opposite choke member a bearing surface to facilitate rotation between the choke members, for example, by being coated or faced with a hard material, which can be erosion resistant, or a friction reducing material, to enhance the bearing properties. Suitable materials include ceramics and harder metals such as tool steel, or other materials such as tungsten carbide.

Optionally each zone in the well that produces fluids from the reservoir is isolated from adjacent zones by a packer or other isolation device. Optionally each zone incorporates at least one choke as described herein, but optionally, each zone can have multiple chokes. Supplying each zone with multiple chokes allows higher inflow rates where conditions permit.

Optionally the choke is deployed in a bore of the well. Optionally the choke is deployed as part of a completion string in the bore of the well. In some embodiments, there is an annulus between the inner surface of the bore of the well (which may optionally be lined or cased or which may be unlined and uncased i.e. open hole) and the outer surface of the completion string. Optionally one or more screens (for example for separating particulate materials such as sand from the fluids in the well) can be deployed in the annulus.

Optionally the first opening allowing fluid communication between the choke and the outside of the conduit permits fluid communication between the choke and the annulus. Optionally the first opening permits fluid communication between the choke and the inner surface of a screen deployed in the annulus. Optionally the screen can be connected to the completion string, and can have a first opening to the annulus between the screen and the inner surface of the bore of the well, and a second opening to the outer surface of the conduit. Optionally the screen comprises a filtration device.

Any feature described in connection with another aspect of the invention is also applicable to the present aspect of the invention where appropriate.

The invention also provides a choke adapted for use downhole in an oil or gas well to control the flow of fluids in a reservoir, the choke comprising:

a conduit with a bore;

a first opening allowing fluid communication between the outside the conduit and the choke;

a second opening allowing fluid communication between the choke and the bore of the conduit;

a flow path connecting the first and second openings;

a flow restrictor that is selectively adjustable to change a cross sectional area of the flow path through the choke, the flow restrictor comprising first and second choke members, each incorporating a portion of the flow path;

wherein at least one of the first and second choke members is rotatable relative to the other to change the cross sectional area of the flow path;

wherein the flow path through the choke members has a portion with an axial component, relative to the bore of the choke.

Optionally the portion with the axial component is spaced radially from the bore of the choke.

Optionally the portion with the axial component is parallel to the axis of the bore of the choke, but in some examples, the flow path through the choke members has a gradually sloping flow path that is non-parallel to the axis, and that transfers fluid between the openings of the choke member in a gradual linear manner, thus the portion has an axial component and a radial component.

Thus the portion with the axial component forms a fluid conduit between regions in the choke that are spaced apart axially and, optionally, also spaced apart radially.

Optionally the flow restrictor is located in the axial portion, and optionally at least a part of the flow path through the flow restrictor is parallel to the axis of the bore of the choke.

Optionally in this aspect each choke member has a mating face that engages a cooperating mating face of the other choke member, and optionally each mating face has an aperture that moves in and out of register with the aperture on the mating face of the other choke member as the at least one choke member rotates relative to the other choke member.

Optionally the choke includes a flow path that changes the direction of fluid flowing through the flow path through 90 degrees between the openings. For example, the flow path can change from a first direction which can be parallel to the axis of the bore of the choke at an outer opening to the annulus, to a second direction which can be perpendicular to the axis of the choke at an inner opening to the bore of the conduit. Optionally fluid flowing axially in the annulus between the choke and the inner surface of the wellbore flows into an axially facing inlet and the flow path through the choke optionally gradually changes through 90 degrees to be generally perpendicular to the axis when it reaches the outlet into the bore of the conduit.

Optionally, the flow path through the choke has at least one radial portion connecting the axial portion to the outer and/or inner surfaces of the choke. Optionally, the at least one radial portion fluidly connects at least one of the openings with the axial portion. Optionally a radial portion can connect each of the openings with the axial portion. Optionally there is one radial portion that connects the axial portion with the opening to the inside of the choke. Optionally the opening to the exterior of the choke can be in an end face of the choke such that the flow path connected to the external opening forms part of the axial portion. Optionally the flow path through the choke members changes the direction of the fluid flowing through the choke, and optionally the directional changes of the pathway are guided by rounded surfaces on the choke members.

Optionally the choke members are driven in relative rotation by a shifting tool, which is optionally deployed on a line or string of tools passing through the bore of the choke. Optionally the line is a wireline or slick line.

Optionally, the shifting tool is deployed in the bore of the choke, and optionally has first and second engaging devices by which the shifting tool can engage the choke, which may optionally be gripping members to facilitate a connection between the shifting tool and the choke. The gripping members can optionally engage the choke with gripping formations which can optionally retain the choke by friction between the two.

In some examples, the engaging devices can optionally be in the form of keys (for example splines, pins, slots etc.) that interact with the choke. Optionally the engaging devices can anchor the tool with respect to the choke and permit it to apply torque to the choke, for example to the rotatable choke member. In one example of the invention, the first and second engaging devices are optionally axially spaced along the shifting tool. Optionally one engaging device is arranged to engage at least one choke member, and the other is arranged to engage a different part of the choke or another part of the conduit. Optionally the shifting tool is arranged to apply torque to turn at least one of the choke members relative to the other. Optionally, the engaging devices connect to the choke, optionally to the inner surface of the choke, and optionally one of the engaging devices is rotatable relative to the other, and engages one of the choke members to cause relative rotation of the choke members. Optionally the engaging devices have at least one or more radially extendable gripping devices, which are moveable radially from a retracted position, in which they do not engage the choke member, to an extended position, in which they engage the inner surface of the choke to connect the shifting tool to the choke. Optionally the radially outermost surfaces of the engaging devices in the form of gripping members have gripping formations, which can optionally be in the form of rough areas, threads, teeth or spikes etc., which grip the inner surface of the choke when the gripping members are radially extended and which can optionally resist displacement by increased friction between the gripping members and the choke.

Optionally the engaging devices move radially under hydraulic power, and are optionally mounted in recesses on the outer surface of the shifting tool, optionally with a seal device such as a resilient seal (O-ring or the like) between the engaging devices and the recess, and optionally with a hydraulic fluid line connecting with the recess behind the seal, allowing the supply of hydraulic fluid to the sealed area behind the engaging device within the recess, to urge the engaging device into the radially extended position. Optionally, the engaging device can be urged into the radially extended position by a resilient device, but it is advantageous to extend the engaging devices by means of hydraulic power, so that the engaging devices retract back into the recesses, for example upon the removal of the hydraulic pressure behind the gripping device. Optionally the extended position of the engaging devices can be maintained by valves.

Optionally, the engaging devices can comprise keys or other formations that engage with specific profiles on the inner surface of the choke body.

Optionally, the first engaging device is able to engage the choke and resist axial movement of the shifting tool and the choke. Optionally the first engaging device engages the body of the choke. Optionally the first engaging device anchors the shifting tool against axial movement in the bore. Optionally the first engaging device rotationally anchors at least a part of the shifting tool to the choke, resisting rotational movement of the engaging device relative to the choke. Optionally the second engaging device is able to engage the rotatable choke member and to rotate relative to the first engaging device, thereby transferring torque from the shifting tool to the choke member, and causing the relative rotation of the choke members in the choke. The engagement of the second engaging device to the rotatable choke member can optionally be in the form of a spline on one and a protrusion on the other, or two inter-engaging protrusions in the form of lugs or dogs etc. Alternatively, the second engaging device and the rotatable choke member can be frictionally engaged.

Optionally the second engaging device does not need to be axially locked to the choke, and only needs to transfer torque between the shifting tool and the choke. The engagement of the first engaging device on the body of the choke can optionally be in the form of a pin engaging in a slot at a fixed rotational position, and at a fixed axial position.

Optionally, the shifting tool incorporates a driver mechanism to drive relative rotation of the engaging devices. Optionally, the driver mechanism may comprise an electric motor, but it is advantageous to use a hydraulic motor, or a hydraulic power supply, as higher torque can be achieved by hydraulic power.

Optionally, the shifting tool can have a telescopic portion between the first and second engaging devices, and optionally the telescopic portion can be motorised, in order to vary the distance between the first and second engaging devices, optionally when at least one of the engaging devices is in the radially extended positions, in engagement with the choke. Optionally, the engaging devices are independently actuable, allowing one of the engaging devices to remain engaged with the choke, and allowing the other to disengage from the choke, move either radially, axially, or rotationally, and re-engage with the choke at a different location on its inner surface. Optionally, the engaging devices are mounted in recesses set in pedestals extending radially from the body of the tool, which can be helpful for increasing the annular area available for fluid flow between the outer surface of the shifting tool and the inner surface of the wellbore.

Optionally, the shifting tool has a positioning system that optionally comprises a sensor on one of the shifting tool and the choke, and a marker on the other. Optionally, the sensor is provided on the shifting tool, or adjacent to the shifting tool on the string, and is supplied with power by the line connecting the shifting tool to the surface. Optionally the marker is provided on the choke, and can be provided on the choke body, or adjacent to the choke, and is optionally detectable by the sensor on the shifting tool when the sensor moves within range of the marker. When this occurs, the sensor optionally reports the position of the shifting tool relative to the choke, because both the sensor and the marker are positioned at known positions on the choke and the shifting tool. The reported position of the shifting tool relative to the choke provides confidence that the rotatable choke member can be engaged by the second engagement device on the shifting tool.

Optionally, the marker can comprise magnets, electromagnets, radioactive markers, RFID markers, physical markers such as recessed profiles and matching keys and suitable detectors can be provided for the sensor. Other markers and sensors capable of identifying relative positions are also suitable, and the invention is not limited to the particular forms of markers and sensors that are described herein. In one particular aspect of the invention, the sensor can comprise a radioactive sensor, and the marker can comprise a radioactive marker. In one particular aspect of the invention, the sensor can comprise an electromagnetic sensor, and the marker can comprise an electromagnetic marker. This can optionally be particularly beneficial, because a magnetic field generated by a marker will optionally have a null point at a predictable position, optionally at the centre of the field, and optionally, the null point can act as an additional positional marker allowing a sensitive indication of the relative position of the marker and sensor. A suitable marker and sensor and method of operation of the same are described in PCT/GB2014/050601 filed on 28 Feb. 2014, the disclosure of which is incorporated herein by reference. A number of different sensors and markers can be incorporated in the shifting tool and/or the choke.

Optionally, the choke has portions of the inner surface of the bore that are adapted for receiving the engaging devices. Optionally, the radially outermost faces of the engaging devices are matched to the same circumferential profile as the inner surfaces of the choke which are intended to engage them, and optionally the radially outermost faces of the engaging devices can incorporate gripping formations such as spikes or threads etc. The radius of curvature of the radially outermost faces of the engaging devices can optionally be matched to the radius of curvature of the inner surface of the bore of the choke. Optionally, the sections of the choke that are adapted for engagement with the engaging devices can be hardened to withstand the radial force applied by the engaging devices on the choke. Optionally, the sections of the choke can be roughened or otherwise treated so as to present a high friction surface for engagement with the engaging devices of the shifting tool. This enhances the grip of the shifting tool on the choke, and reduces the susceptibility of the choke to damage resulting from engagement by the shifting tool. For example, the inner surface of the rotatable choke member can optionally have a hardened band extending around the inner surface of the rotatable choke member, and optionally extending axially along the rotatable choke member for a sufficient distance to enable accurate engagement of the hardened band by the engaging device of the shifting tool.

Optionally the shifting tool is deployed on a string that comprises a logging tool to detect and report on the well bore conditions at different depths of the well. Optionally the logging tool is capable of plotting the depth of the tool and identifying the different zones of the completion tubing and the tools within those zones. Optionally the string on which the shifting tool is deployed has a communication package enabling reporting of the logged information to the surface, and optionally allowing power and transmission of data and instructions from the surface to the tool. Optionally the communication package can detect and transmit data from the shifting tool relating to the rotational position of the choke, for example, the relative rotational positions of the first and second choke members. This can be used to detect, report and optionally record the rotational position(s) of the choke during the operation of the choke.

Optionally the string in which the shifting tool is deployed incorporates a downhole tractor capable of driving axial movement of the string within the wellbore. Optionally, the downhole tractor incorporates wheels, tracks or other traction devices in order to drive the tractor and the rest of the string along the wellbore. Optionally, the traction devices can be retractable into the body of the tractor when the string is being pulled out of the hole, in order to increase the annular area available for fluid flow past the string between the outer surface of the string and the inner surface of the wellbore.

The invention also provides a wellbore completion system comprising a choke as herein defined. The invention also provides a well having a choke as herein defined.

The invention also provides a method of controlling flow of fluid in an oil or gas well, comprising providing a choke in the well to control the flow of fluid between a reservoir and a bore of a conduit in the well, the choke having:

a first opening to the outside of the conduit allowing fluid communication between the outside of the conduit and the choke;

a second opening inside the bore of the conduit allowing fluid communication between the choke and the bore of the conduit;

a flow path connecting the first and second openings, the flow path incorporating a flow restrictor that is selectively adjustable to change the cross sectional area of the flow path through the choke, and the flow restrictor comprising first and second choke members, each incorporating a portion of the flow path;

wherein at least one of the first and second choke members is rotatable relative to the other to change the cross sectional area of the flow path through the choke; the method comprising controlling the flow of fluid into the well by rotating at least one choke member relative to the other.

Optionally each choke member has a mating face adapted to engage a cooperating mating face of the other choke member, and wherein each mating face has at least one aperture that moves relative to the aperture on the mating face of the other choke member as the at least one choke member rotates relative to the other.

Optionally the choke incorporates a piston device as described above.

The invention also provides a method of varying the flow of fluid in the bore of an oil or gas well, including coupling a screen to a choke, the choke comprising a flow restrictor that is selectively adjustable to change a cross sectional area of a flow path through the choke, running the choke and coupled screen into the bore, applying a torque to the choke downhole and thereby adjusting the cross sectional area of the flow path through the choke to vary the flow of fluid between the screen and the choke.

The invention also provides a flow control assembly adapted for use in the bore of an oil or gas well, the flow control assembly comprising a screen and a choke having a flow restrictor that is selectively adjustable to change a cross sectional area of a flow path through the choke, and wherein the cross sectional area of the flow path through the choke is adjustable downhole to vary the flow of fluid between the screen and the choke.

Optionally the choke in the flow control assembly can have first and second axially spaced choke members as previously described, and optionally the choke can be axially spaced from the screen in the flow control assembly. Optionally the choke and the screen can be axially stacked in the assembly, and components of the choke can optionally have diameters (for example outer diameters) which overlap with diameters (for example inner diameters) of components of the screen.

Optionally the cross-sectional area of the flow path through the choke can be adjusted from the surface while the screen in the bore of the well, allowing adjustment of the choke after the screen has been deployed, for example, while it is being run into the hole, and/or when it is in place in a zone of the reservoir, and/or when it is being moved in the bore. Optionally the choke can be adjusted by the shifting tool described above.

Optionally the screen can comprise a multi-layer screen having more than one layer of filter material, each layer of filter material being adapted to resist passage of particulates through the screen. Optionally different layers of filter material have different pore sizes in the filter material and are adapted to resist passage of particulates with different particle size distribution ns.

Optionally the flow control assembly can be deployed in the bore of the well and the conditions (e.g. conditions of the fluids, such as density, flow rate, viscosity, temperature, etc.) in the bore of the well can be measured and optionally recorded and/or transmitted back to the surface for recording and analysis by a logging tool when the flow control assembly is in place in the well.

Optionally the logging tool trips through the bore of the flow control assembly logging the wellbore conditions (fluid flow rates, density, temperature etc.) and optionally logging the positions of the flow control assembly in the bore, and particularly (but not exclusively) the positions of the chokes within the bore. The logging tool can optionally adjust the cross-sectional area of the chokes by rotating a part of the choke in the same or a different trip, and can optionally measure (and optionally record or transmit) the effect of the adjustment in the same or on a different trip through the wellbore.

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention. Also, optional features described in relation to one example can optionally be combined alone or together with other features in different examples of the invention. Any subject matter described in the specification can be combined with any other subject matter in the specification to form a novel combination.

Various examples and aspects of the invention will now be described in detail with reference to the accompanying figures. Still other aspects, features, and advantages of the present invention are readily apparent from the entire description thereof, including the figures, which illustrate a number of exemplary aspects and implementations. The invention is also capable of other and different aspects and implementations, and its several details can be modified in various respects, all without departing from the spirit and scope of the present invention. Accordingly, the drawings and descriptions are to be regarded as illustrative in nature, and not as restrictive. Furthermore, the terminology and phraseology used herein is solely used for descriptive purposes and should not be construed as limiting in scope.

Language such as "including" "comprising," "having" "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

In this disclosure, whenever a composition, an element or a group of elements is preceded with the transitional phrase "comprising", it is understood that we also contemplate the same composition, element or group of elements with transitional phrases "consisting essentially of", "consisting", "selected from the group of consisting of", "including", or "is" preceding the recitation of the composition, element or group of elements and vice versa.

All numerical values in this disclosure are understood as being modified by "about". All singular forms of elements, or any other components described herein are understood to include plural forms thereof and vice versa. References to directional and positional descriptions such as upper and lower and directions such as "up", "down" etc. in relation to the valve are to be interpreted by a skilled reader in the context of the examples described and are not to be interpreted as limiting the invention to the literal interpretation of the term, but instead should be as understood by the skilled addressee. In particular, positional references to the well such as "up" will be interpreted to refer to a direction toward the surface, and "down" will be interpreted to refer to a direction away from the surface, whether the well being referred to in a conventional vertical well or a deviated well.

The choke of the invention can be used in any situation where variable fluid flow is desired. The choke can be used in cased hole, lined hole, open hole, vertical wells, horizontal or non-vertical or deviated wells and all other types of wells.

BRIEF DESCRIPTION OF ACCOMPANYING DRAWINGS

DETAILED DESCRIPTION OF ONE OR MORE EXAMPLES OF THE INVENTION

Figure 1:
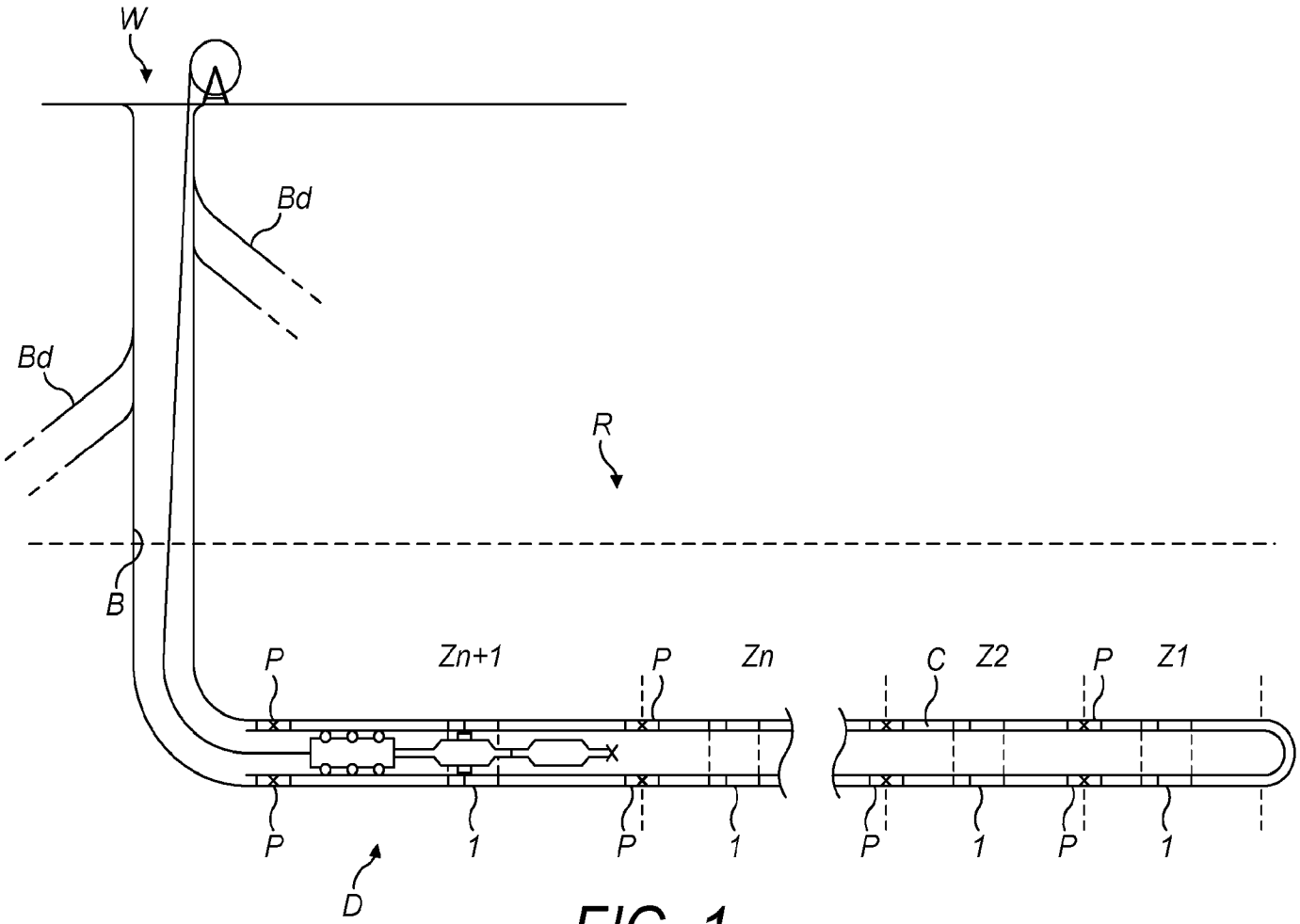
FIG. 1 is a schematic view of an oil or gas well, incorporating a choke.

Referring now to the drawings, an oil or gas well W shown in FIG. 1 optionally has a number of deviated wellbores Bd extending from the main bore B of the well W. Optionally a choke in accordance with the present invention is deployed in a deviated wellbore. In the present example, the main wellbore B terminates in a reservoir R from which valuable hydrocarbon-rich production fluids are to be recovered. In the present example, the wellbore B is being produced from a deviated portion D at the lower end of the wellbore B. The deviated portion D is divided into separate zones i.e. z1, z2 . . . zn, zn+1, which are separated from one another by packers P or other isolation tools which occlude the annulus between a string of completion tubing C and the inner surface of the wellbore. The completion tubing C is in fluid communication with the surface, for example, using production tubing (not shown) leading to the surface, and as will be known to the person skilled in the art, fluids such as production fluids from the reservoir outside of the wellbore portion D flow through the formation into the wellbore, emerging into the annulus between the inner surface of the wellbore portion D and the outer surface of the completion tubing C, and from there flow into the inner bore of the completion tubing C through chokes set into the completion tubing C. The packers P isolate the annulus between adjacent zones, allowing each isolated zone to be produced independently of other zones in the well.

In the present example, each zone has at least one choke 1 which controls the flow of production fluids from the annulus into the bore of the completion tubing C. Each zone can optionally have more than one choke 1.

Figure 2:
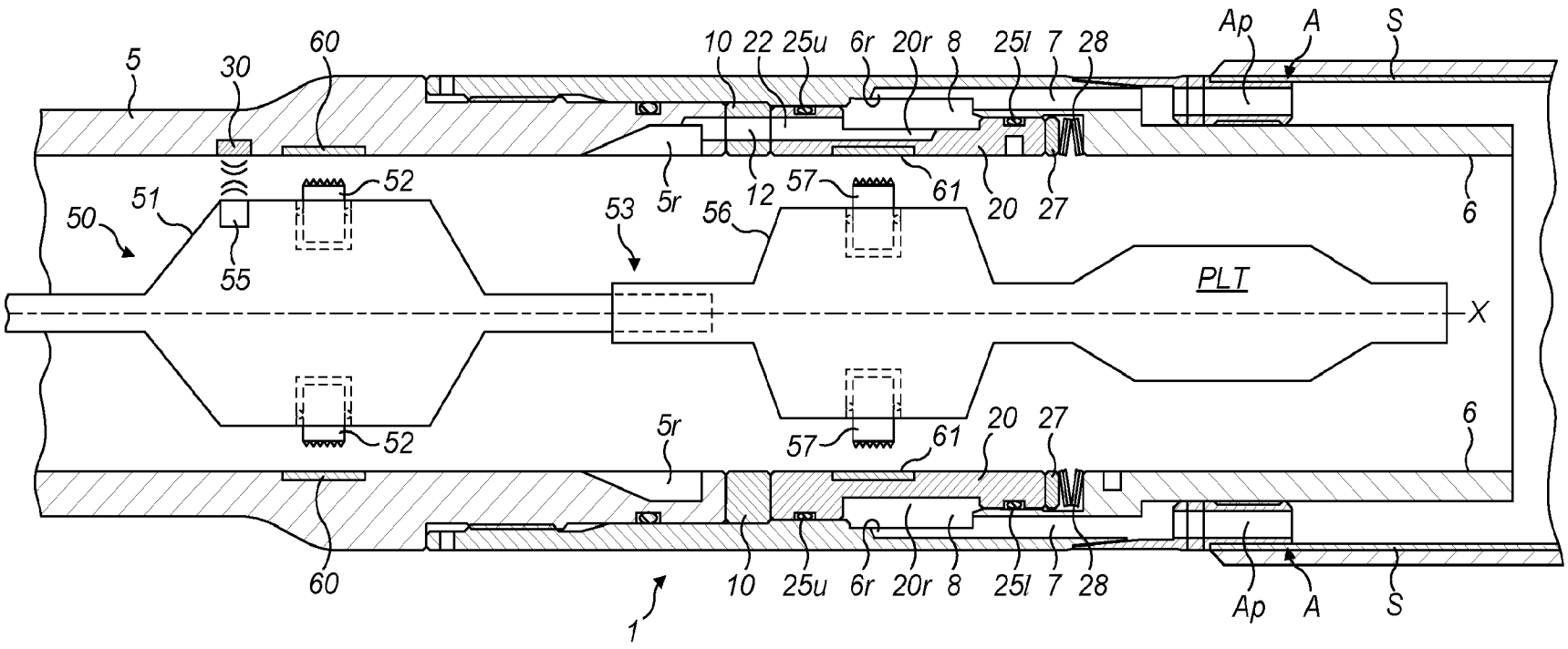
FIG. 2 is a side sectional view of the choke in the FIG. 1 well.

With reference to FIG. 2, each choke 1 has a body comprising an upper body member 5 and a lower body member 6. The body members 5, 6 optionally have end connections such as box and pin connections to connect the body into the completion tubing C. The choke 1 provides a flow path for fluid to pass between the annulus and the bore of the completion tubing C, via the body, for example, for recovery of fluids such as production fluids to the surface. The lower body member 6 has an internal thread on its upper end, which cooperates with an external thread on the upper body member 5, to connect the body members together when the upper body member 5 is received within the bore of the lower body member 6. Optionally, a resilient seal such as an O-ring seal is compressed between the two when the connection is made up. The lower body member 6 has, on its lower end, an adapter A for a screen S to filter fluids flowing into the annulus of the wellbore from the formation, allowing fluids to enter the screen S, and excluding particulate materials above a particular size range, which may vary with the screen S. The screen S is optionally a multi-layer screen having more than one layer of perforated mesh forming a filter. Optionally the different layers of the perforated mesh have different pore sizes adapted to filter out different particle sizes from the fluids. Hence, an outer layer may be adapted to resist passage of larger diameter particles than inner layers.

The adaptor A has an upper socket with an internal thread, and is coupled to the lower body member 6 by the internal threads on the socket which cooperate with external threads on the lower end of the lower body member 6. The upper socket can be tapered and can have an upper axial end face that abuts a shoulder on the lower body member 6 when the adaptor A is made up to the lower body member 6. Optionally the externally threaded part of the lower body portion has a matching taper to cooperate with the taper on the upper socket of the adaptor A.

Suitable forms of screen S will be known to a person skilled in the art. The lower body member 6 has a circumferential array of inlet bores 7 extending parallel to the axis and connecting the outer surface of the lower body member 6 within the annulus between the screen S and the body with a recess 6*r* forming part of a chamber 8 inside the body, guiding production fluids from the screen annulus into the bore of the completion tubing C. The inlet bores 7 are optionally spaced around the circumference of the lower body member, and can optionally be spaced at regular circumferential intervals around the body within the array. The adapter A has an array of axial ports Ap which are circumferentially spaced from one another, and which are generally parallel to the inlet bores 7. In this example (although not essential) the ports Ap in the adapter A are circumferentially aligned with the inlet bores 7 as shown in FIG. 2. Accordingly fluids flowing from the outside of the screen S into the annulus between the screen S and the body flow through the ports Ap in the adapter A, then through the axial inlet bores 7 and into the chamber 8, without substantial deviation of their direction of flow.

The choke 1 has two choke members in the form of cylinders with a central bore that are located radially inside the body, optionally within the lower body member 6. One of the choke members is fixed relative to the body in this example, and one is rotatable within the body. However in certain other examples of the invention, both of the choke members could be rotatable. The fixed choke member 10 is optionally fixed in the body between a lower end of their upper body member 5 and an upwardly facing shoulder protruding from the inner surface of the lower body member 6. The fixed choke member 10 is optionally offered to the bore of the lower body member 6 before the upper body member 5, so that when the upper and lower body members are screwed axially together, the fixed choke member 10 is secured immovably between them. The fixed choke member 10 has a central axial bore which is co-axial with the bore of the body, and an aperture 12 passing axially through the wall on one side of the choke member 12, providing an axial flow path through the choke member 12, which is parallel to the central bore. The aperture 12 is optionally arranged on an arc, which circumscribes less than 180° of the circumference of the fixed choke member 10. Optionally, the fixed choke member 10 is indexed to the upper body member 5, and the aperture 12 is optionally rotationally aligned with a similarly-shaped aperture Sa in the lower end of the upper body member 5. The aperture Sa in the lower end of the upper body member 5 is in fluid communication through an axial channel with a recess Sr on the inner face of the upper body member 5, which opens into the bore of the choke 1, and which forms the outlet of the choke.

In this example, the fixed choke member 10 comprises a separate component that is secured to the body, but in some other examples, it would be possible to provide the fixed choke member as an integral part of the body, without the requirement for it to be a separate component.

The rotatable choke member 20 has a recess 20*r* on its outer surface which is axially aligned with the recess 6*r* on the inner surface of the lower body member 6. Optionally, the recesses 20*r* and 6*r* together form a chamber between the rotatable choke member 20 and the inner surface of the lower body member 6, which receives the fluid flowing in from the circumferential array of inlet bores 7. The rotatable choke member 20 optionally has a central bore which is co-axial with the bore of the body and with the bore of the first choke member 10. Adjacent to, and optionally above the recess 20*r*, the rotatable choke member 20 also has an arcuate aperture 22 providing an axial flow path through the choke member 20, which is parallel to the central bore, and which circumscribes less than 180° of the circumference of the rotatable choke member 20, in the same way as is described in relation to the fixed choke member 10. The arcuate aperture 22 is in fluid communication with the recess 20*r*, optionally with upper end of the recess 20*r*, so that fluids can flow from the recess into the aperture.

The choke members 10, 20 and their respective openings are axially spaced apart with respect to the axis of the choke.

When the choke members 10, 20 are axially stacked together with their central bores in alignment, and when the apertures 12, 22 are at least partially in rotational alignment with one another, production fluids entering the annulus between the choke and the inner surface of the wellbore can flow through the screens, and into the inlet bores 7 of the choke, entering the chamber 8, and through the flow path comprising the arcuate apertures 22 and 12 in the rotatable and fixed choke members 20, 10. Optionally, the apertures 12, 22 provide a flow restrictor within the flow path between the outer and inner surface of the body of the choke 1, which is adjustable by relative rotation of at least one of the choke members. In this example, rotation of the rotatable choke member 20 relative to the fixed choke member 10 around the axis of the central bore changes the extent of overlap between the apertures 12, 22, and adjusts the surface area of the flow restrictor between 0 and 100%. Optionally the maximum surface area of the flow restrictor (which occurs when that the apertures 12, 22 are in full alignment) is less than the surface area of the remainder of the flow path between the outer surface and the inner surface of the body of the choke 1, so that the overlap resulting from the alignment of the choke members 10, 20 provides the flow restrictor within the flow path through the body of the choke 1.

The lower face of the fixed choke member 10 is optionally pressed axially against (i.e. in direct contact with) the upper face of the rotating choke member 20 in an axial stack, and these two faces optionally provide the mating faces of the choke members. The mating faces of the choke members 10, 20 (and optionally the apertures through them) can optionally be faced with a bearing material comprising a coating or facing that resists erosion from fluid flowing through the apertures, or that enhance rotation by, e.g. reducing friction between the mating faces as they rotate. Optionally the mating faces are coated or faced with ceramic materials or tungsten carbide. Other bearing materials can optionally be used. Optionally the mating faces between the choke members can be polished or treated in some other way to enhance bearing properties. Optionally the whole of the fixed choke member 10 can be formed from a hardened material such as a ceramic etc. The example shown has such a fixed choke member, which is fitted as a separate part to the upper body member 5, but in other examples, the fixed choke member can optionally be formed as an integral part of the upper body member, and can optionally be faced with a hardened layer. Optionally the whole of the rotatable choke member 20 can also be formed from a hardened material such as a ceramic or Tungsten Carbide.

The rotatable choke member 20 is optionally sealed to the inner surface of the lower body member 6 by upper and lower seals 25*u* and 25*l* which are compressed between the outer surface of the rotatable choke member 20 and the inner surface of the lower body member 6. Optionally, the upper seal 25*u* has a larger sealed diameter than the lower seal 25*l*. Optionally the seals 25 can comprise O-ring seals, and are optionally resilient, but other seals can be used in different examples.

Optionally, the rotatable choke member 20 is disposed within the bore of the lower body member 6 between the lower end of the fixed body member 10, and a washer 27, biased upwardly within the body by a resilient device in the form of a spring 28, which is optionally held in compression between the washer and an inwardly extending and upwardly facing shoulder on the inner surface of the lower body member 6. The rotatable choke member 20 is urged against the lower end of the fixed choke member 10 by the force of the compressed spring 28. Optionally, the mating faces of the washer 27 and the rotatable choke member 20 have inter-engaging indexing formations, which optionally maintain the rotational orientation of the rotatable choke member 20 relative to the washer 27, which can optionally be rotationally connected through the spring 28 to the inwardly extending shoulder on the lower body member 6. The inter-engaging indexing formations between the washer 27 and the rotatable choke member 20 optionally limit the rotation of the rotatable choke member, permitting rotation of the rotatable choke member 20 relative to the body within certain limits, and indexing the rotation to certain predictable rotational positions of the rotatable choke member 20 relative to the body. The effect of this is that in the absence of other forces, the low force of the spring 28 urges the washer 27 upwards in the bore, pushing the rotatable choke member 20 upwards against the fixed choke member 10, and maintaining the rotational position of the rotatable choke member 20 in a predictable range of positions relative to the body by virtue of the indexing inter-engaging formations. However, when it is desired to adjust the area of the flow restriction through the choke, relatively low rotational forces applied to the rotatable choke member 20 within the body can optionally overcome the force applied by the spring 28 to the indexing formations between the washer 27 and the choke member 20, and allow the rotatable choke member 20 to rotate within the body (to certain fixed rotational positions governed by the indexing mechanism of the inter-engaging formations) relative to the body and the fixed choke member 10, which changes the area of the flow restriction, and adjusts the flow rate of production fluids from the annulus through the choke and into the completion tubing. The differential areas between the seals on the choke member 20 can be manipulated along with the area of the aperture 22 and the sealed area between the choke members 10, 20 in order to reduce or cancel out the differential fluid pressure tending to urge the choke members together, so that the force urging the choke members together to make up the seal is applied substantially by the spring 28, which remains relatively constant at different pressure differentials between the inside of the choke and the annulus between the choke and the wellbore.

Figure 3:
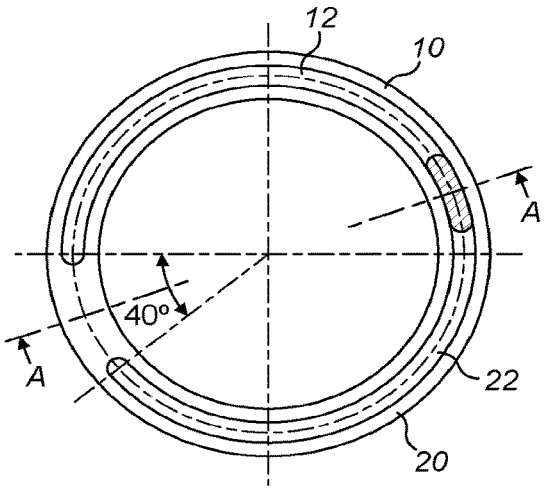
FIG. 3 is an end view of two superimposed choke members of the FIG. 2 choke showing the configuration of the choke members when the choke is in the partially open position (16% open)
Figure 4:
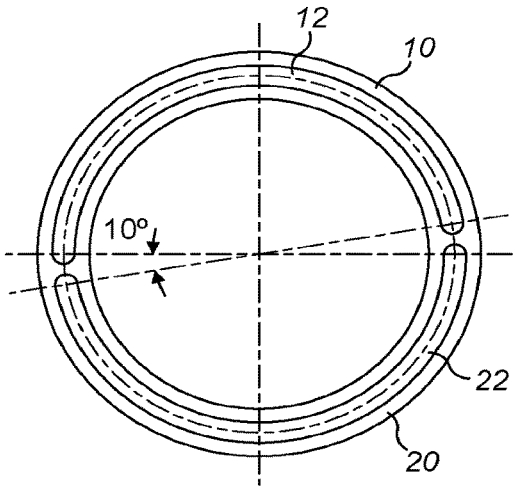
FIG. 4 is a view similar to FIG. 3 showing the superimposed configuration of the choke members when the choke is in the closed position.
Figure 5:
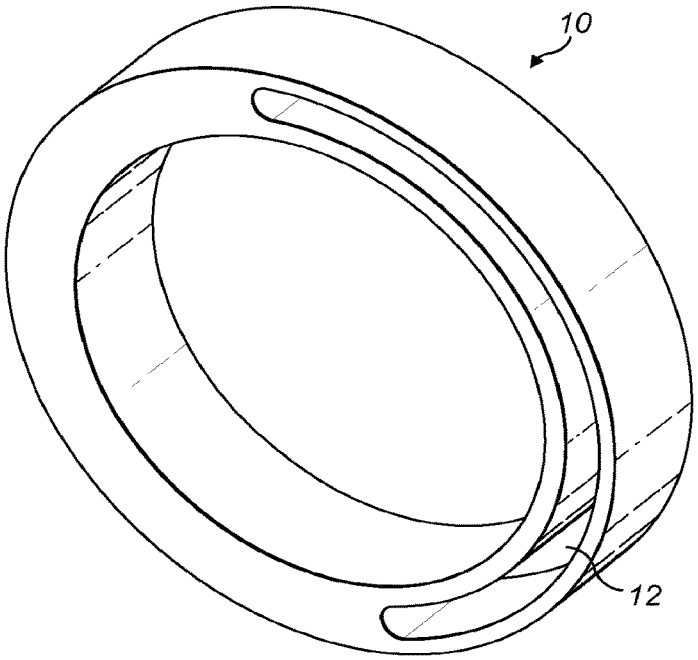
FIG. 5 is a perspective view of a fixed choke member from the FIG. 2 choke.

Referring now to FIG. 3, the two choke members 10, 20 are shown superimposed on one another, illustrating the overlap between the apertures 12 and 22 in different rotational positions of the rotatable choke member 20 relative to the fixed choke member 10. In the FIG. 3 configuration of the choke members 10, 20, there is a 16% overlap between the apertures 12, 22, which is shown at the upper side of the FIG. 2 configuration of the choke 1, with the flow restrictor between the choke members 10, 20 the open, and permitting fluids to pass from the annulus outside the completion tubing C, to the internal bore. Continued anticlockwise rotation of the rotatable choke member 20 relative to the fixed choke member 10 from the position shown in FIG. 3 increases the extent of overlap between the apertures 12, 22, increasing the area of the flow restriction through which fluid can pass, until the apertures 12, 22 are axially aligned with one another. At the 100% open position, the cross-sectional area of the flow restriction (in this embodiment) is 1.713 in.$^2$ (approximately 11.05 cm$^2$). Clearly the actual values can be changed in other examples of the invention. Conversely, rotating the rotatable choke member 20 clockwise (when viewed from the FIG. 3 view) rotates the apertures out of register with one another to the position shown in FIG. 4, in which there is no overlapping cross-sectional area between the apertures, and the flow restrictor is essentially closed.

In the example shown, the apertures maintain a consistent cross-sectional area around the arc. However, in certain other examples of the invention, this is not necessary, and one or both of the apertures can optionally increase or decrease in cross-sectional area around the arc. For example, one of the choke members (for example the rotatable choke member) can have a number of apertures circumferentially arranged on the arc, and the apertures can optionally decrease in size from one end of the arc to the other. The decrease can optionally be linear, or non-linear. Alternatively, the rotatable choke member can optionally have a single aperture with a varying cross-sectional area, for example in the form of a teardrop, having a first end at one rotational position on the arc with a large cross-sectional area, and a second end with a smaller cross-sectional area. The change in the cross-sectional area between the ends can be linear or non-linear.

Referring now to FIG. 2, limitation of the rotatable choke member 20 relative to the fixed choke member 10 is performed by a shifting tool 50, which is inserted into the bore of the completion tubing on a string of tools, optionally lowered by a line such as wireline, as shown in FIG. 1. The shifting tool 50 optionally has two anchor members 51, 56, each of which optionally has at least one engaging device to engage the choke. Optionally, there are first and second engaging devices each on a respective anchor member 51, 56. In the present example, the engaging devices are optionally in the form of radially extending cylinders 52, 57 housed in radial chambers within pillars on the anchor members 51, 56. Optionally, the pillars extend radially from the body of the shifting tool 50, and can optionally be equally spaced around the circumference of the body of the shifting tool 50, so that the force applied by the radially extending cylinders 52, 57 is balanced around the circumference of the shifting tool. In the example shown, two cylinders 52, 57 are shown on each of the anchor members 51, 56, but in other examples of the invention, 3, 4 or more engaging devices can be provided on each anchor member, optionally with an equal, or at least a symmetrical, spacing, so as to equalise the force applied on the choke by the extension of the cylinders from the chambers. Optionally, the pillars can be relatively narrow and take up relatively little circumferential space on the shifting tool 50, so as to maximise the area available for fluid flow along the bore past the shifting tool during running in and pulling out operations. Optionally, the shifting tool 50 is disposed between a tractor and a production logging tool within the string.

Optionally the shifting tool 50 is run into the hole with the cylinders 52, 57 retracted within the chambers, out of engagement with the inner surface of the completion tubing C. Optionally, the string of tools is run into the hole under gravity, but if the wellbore deviates to such an extent that gravitational insertion is no longer efficient, then optionally, the string can be driven into the hole by a tractor within the string; optionally the tractor has retractable wheels to maximise fluid pathways past the string during running in or pulling out. The tractor is optional, and it is possible to obtain satisfactory results in non-deviated wellbores without it. Optionally the string is run to the bottom of the well and pulled out while logging the well, optionally focusing on the different zones of interest in the completion tubing that incorporate the chokes in each zone. The initial logging run is performed in order to establish baseline flow profiles for each zone. This may be done a number of times, in order to establish consistent flow rate measurements in each zone. As well as the quantity of production fluids obtained from each zone, the production logging run can optionally gather information as to the quality of the production fluids, and particularly the water content. After the production logging run, or optionally during one of them, the string is driven to the bottom of the well, and optionally on the way in, the production logging tool identifies the various components of the well, logging their depths and positions in the well relative to one another. Optionally, the string can then be pulled out of the well, and the respective chokes in each zone can be adjusted to a new setting on the way out. This is particularly useful to close off chokes present in the zones that are producing high levels of water in the production fluids, or possibly to open chokes in zones that are particularly rich in hydrocarbons. Further logging runs can then be performed to assess the effect of the adjustments, and to make further adjustments if necessary.

To adjust the fluid flow restrictor through each choke, the shifting tool 15 is optionally positioned in the bore of the well to be approximately located within the bore of the choke. Optionally, the choke incorporates a marker that is detectable by the sensor on the shifting tool. Optionally, the marker comprises an RFID tag, and the sensor comprises an antenna on the shifting tool. Optionally, the marker can be provided on the shifting tool, and the sensor on the choke. It is sufficient that the sensor detects the approach of the marker, and indicates to the operator at the surface that the shifting tool is approaching the correct position from which to adjust the flow restrictor through the flow path of the choke. In the present embodiment, a suitable marker is provided on the choke in the form of a magnetic marker 30 such as that described in PCT/GB2014/050601. Optionally, the sensor is provided on the shifting tool, and draws power from the line supplying the shifting tool, and optionally also relays data and receives instructions through the line. The sensor is optionally in the form of an electromagnetic induction coil SS, such as that described in PCT/GB2014/050601, the disclosure of which is incorporated herein by reference. Optionally, the general location of each choke within the well will be approximately known from the production logging runs, and from depth measurements, so the operator can usually position the shifting tool within the correct general vicinity of the choke to be adjusted, and in some examples, can optionally use the marker and sensor to adjust the fine positioning of the shifting tool within the bore of the choke before carrying out the rotation to adjust the flow restrictor. Electromagnetic markers and sensors are particularly useful for fine tuning of positioning within the well, as the magnetic field optionally has a very narrow null point, at its centre, which can optionally be used to indicate the precise location of the shifting tool within the well.

Figure 6:
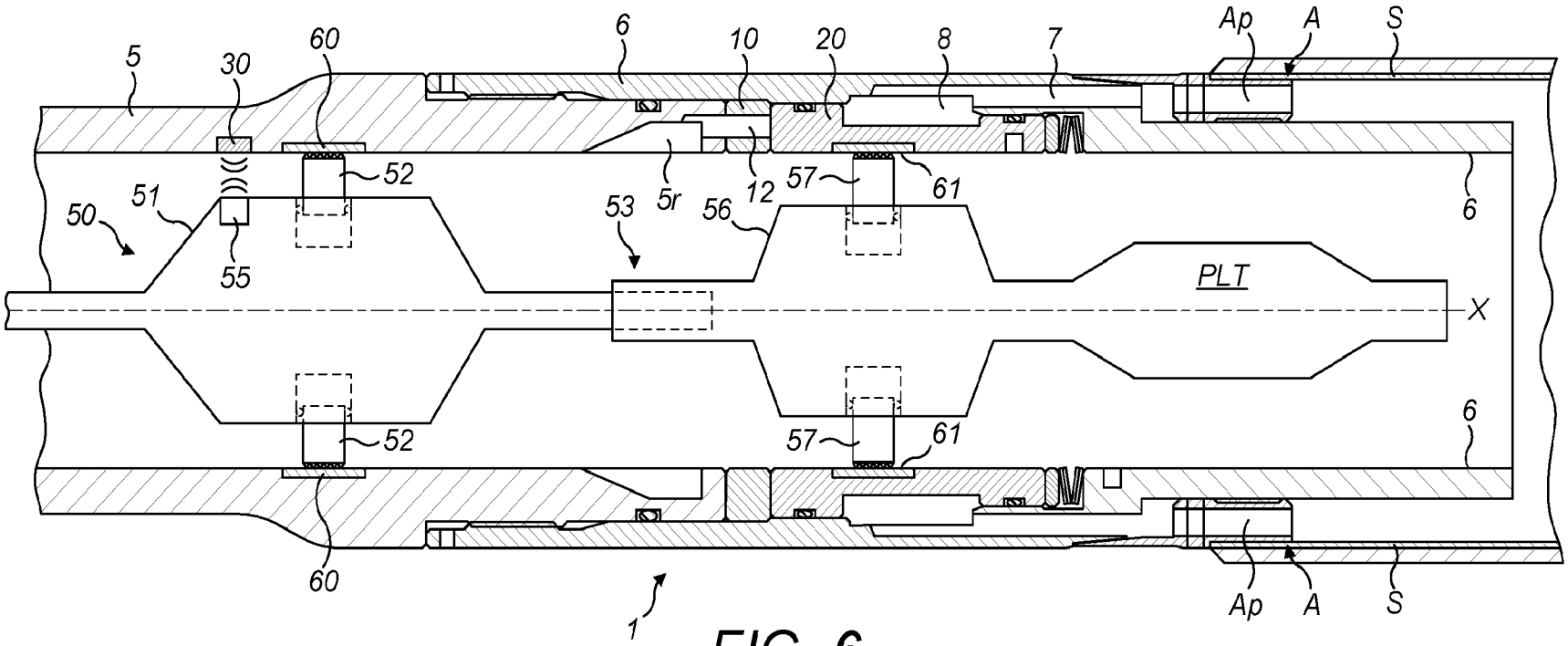
FIG. 6 is a side sectional view of the FIG. 2 choke with a shifting tool acting on the choke members.
Figure 7:
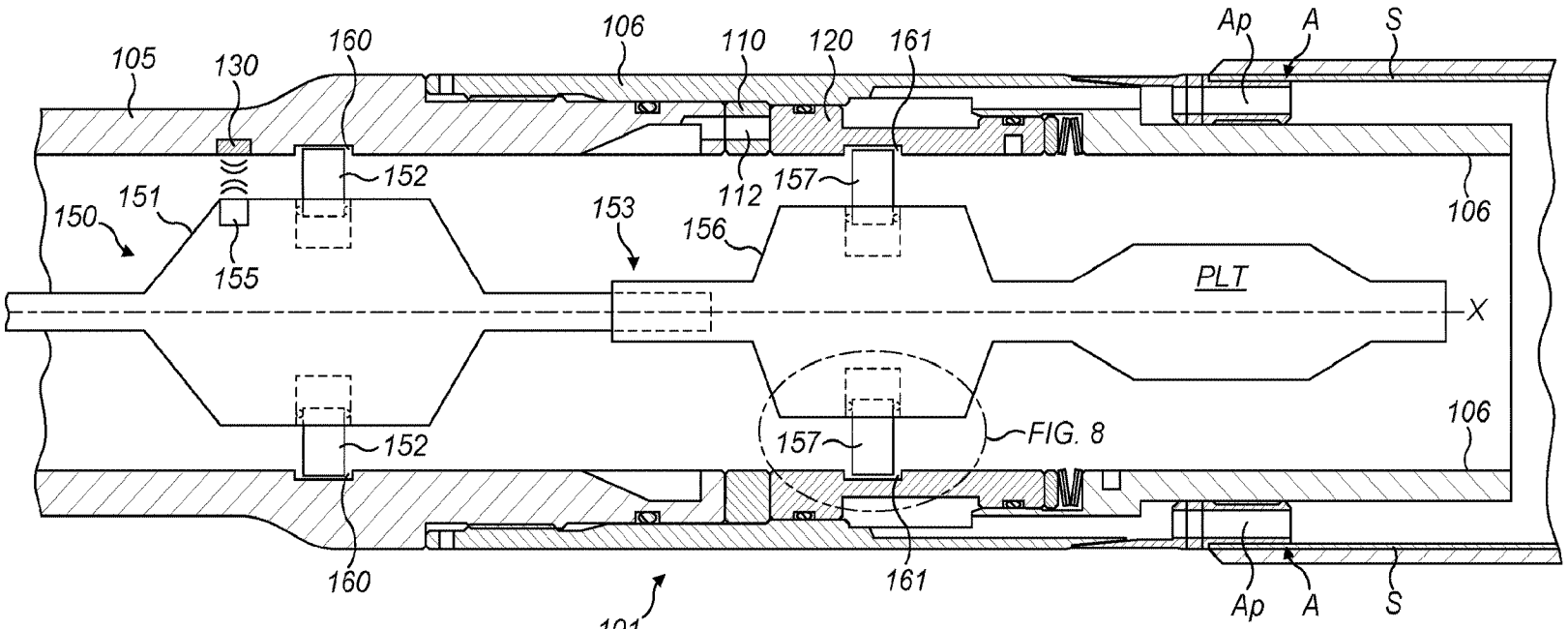
FIG. 7 is a side sectional view similar to FIG. 6, showing a second choke with a second shifting tool acting on the choke members.
Figure 8:
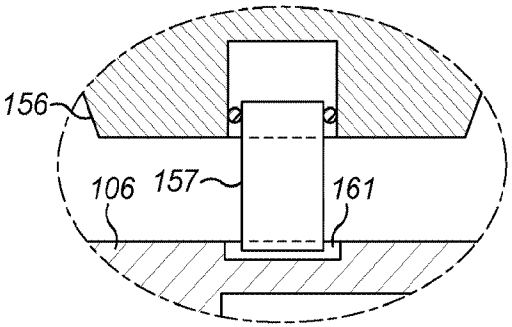
FIG. 8 is a close up view of one of the engaging members on the shifting tool shown in FIG. 7.
Figure 9:
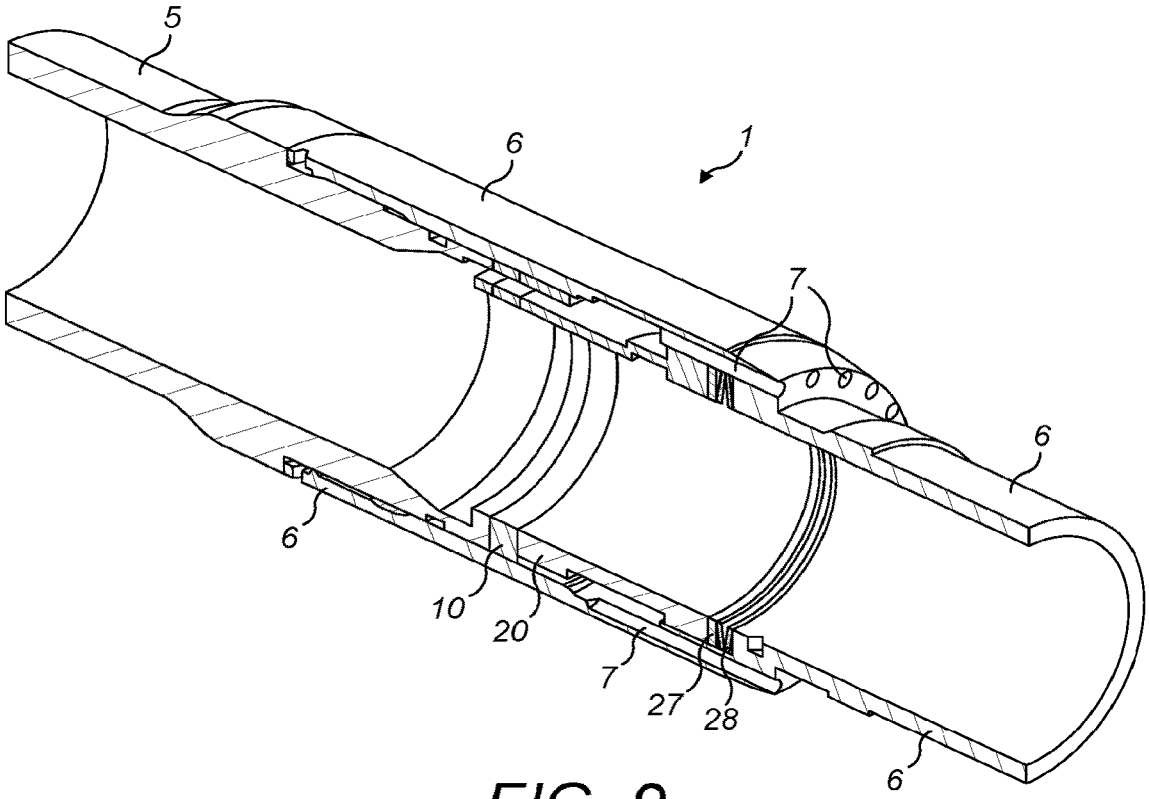
FIG. 9 is a sectional perspective view through the FIG. 2 choke with the shifting tool removed, and the choke open.
Figure 10:
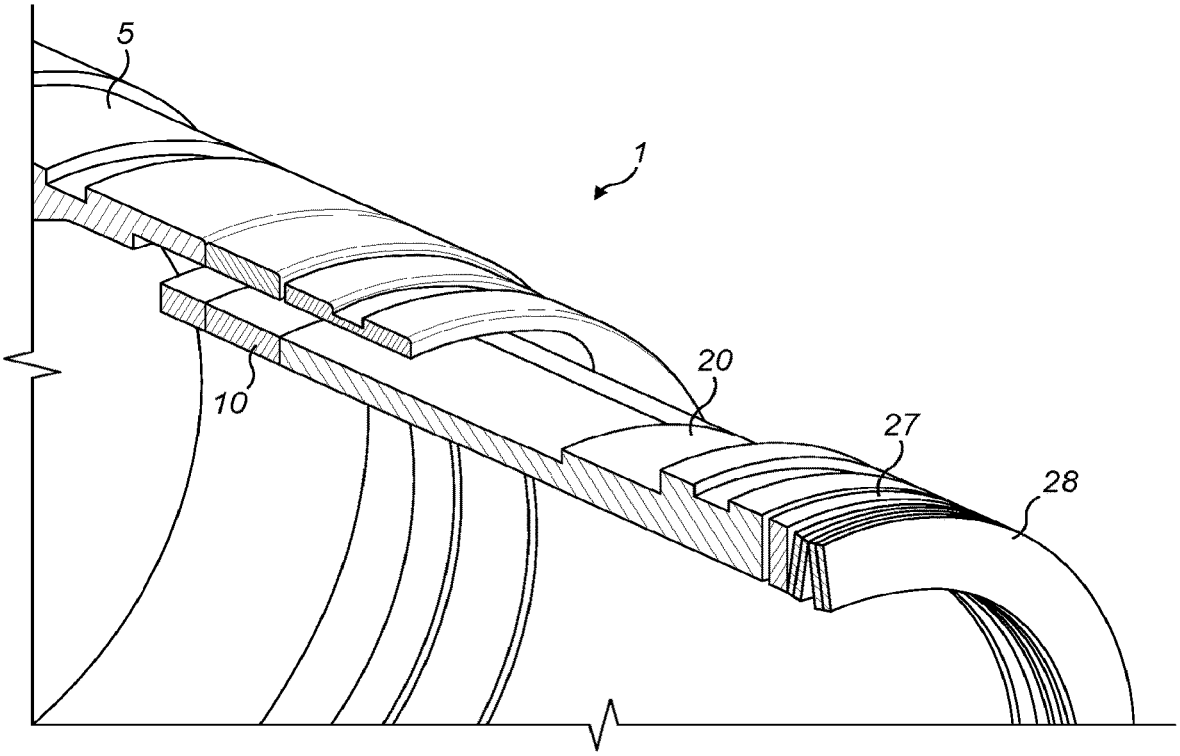
FIG. 10 is a close up view of a portion of FIG. 9, with a lower body member removed showing internal parts.

Optionally, the inner surface of the choke has hardened and/or roughened areas that are engaged by the engaging devices on the shifting tool. Optionally, the relative positions of the marker and the sensor are arranged such that when the desired relative positions of the marker and sensor are detected, the engaging devices on the shifting tool are in axial alignment with the hardened and/or roughened areas on the inner surface of the choke. Note that the hardened and/or roughened areas are optional, and the inner surface of the choke may instead be provided with profiles that are engaged by keys on the shifting tool, which are shown in the choke of FIGS. 7 and 8. The choke shown in FIGS. 2-6 optionally has the hardened and/or roughened areas in the form of bands 60, 61 of hardened material such as tungsten carbide as herein described. The radially outermost surfaces of the cylinders 52, 57 optionally have engaging profiles in the form of threads, which can optionally be crosscut to grip the bands 60, 61. Optionally the bands and/or the radially outermost surfaces of the cylinders 52, 57 can be faced with materials that increase friction, and thereby enhance the grip.

Optionally, the cylinders 52, 57 are driven radially outwards from the chambers by means of hydraulic fluid pressure supplied through hydraulic fluid lines passing through the shifting tool 50. The supply of hydraulic fluid can optionally be carried on the shifting tool 50. Other driving mechanisms are feasible, such as electric motors etc. Pressure differentials across the seals between the cylinders 52, 57 and the chambers are optionally sufficient to extend the cylinders 52, 57 radially outwards, to grip the bands 60, 61, when the shifting tool 50 is in place. Optionally, the shifting tool 50 is run into position in the well with the axial distance between the cylinders 52, 57 being set at the same distance between the known axial spacing between the bands 60, 61. Optionally, an axial telescopic joint 53 is provided in the shifting tool to adjust the axial spacing between the two anchor members 51, 56. Optionally, the telescopic joint 53 can be adjusted by means of hydraulic power, optionally supplied by a hydraulic motor within the shifting tool. Optionally, the hydraulic motor, or the reservoir of hydraulic fluid can be supplied on another tool within the string. Optionally, the telescopic joint 53 can be adjusted by means of motive force from a different motor, for example an electric motor, and a separate motor and gearbox can optionally be provided. Optionally, the telescopic joint 53 allows relative rotation of the anchor members 51, 56. Optionally the power for driving relative rotation of the anchor members 51, 56 can be supplied from a hydraulic motor. An electric motor is also suitable, but higher torque can optionally be achieved through a supply of hydraulic fluid.

Optionally, when the shifting tool 50 is in a suitable location to adjust the flow restrictor in the choke 1, as reported by the marker and sensor, the first anchor in the form of the cylinders 52 is actuated to drive the cylinders 52 radially outward from the chambers, and into contact with the band 60 in order to secure the first anchor member 51 to the upper body portion 5 of the choke. After the first anchor member 51 has been secured to the choke body, the telescopic joint 53 can be extended or retracted to adjust the relative position of the first and second anchor members 51, 56, so that the cylinders 57 are in axial alignment with, and radially inside, the band 61. Once the correct axial position has been achieved, the cylinders 57 are actuated in order to drive them radially outward, into contact with the band 61, to secure the second anchor member 56 onto the rotatable choke member 20. Optionally, the cylinders 52, 57 are driven axially with sufficient power to secure the shifting tool against axial movement within the choke, and to allow transfer of torque between the anchor members 51, 56. Because of the high friction interface between the shifting tool 50 and the choke, the tool can be engaged with the choke at relatively low radial forces.

At this point, the telescopic joint 53 between the anchor members 51, 56 is driven in rotation, by means of the hydraulic motor (or the electric or other motor) in order to rotate the rotatable choke member 20 by the desired amount to adjust the flow restriction. In the configuration shown in FIG. 6, the rotational choke member 20 has been rotated from the partially open position shown in FIG. 2, to move the aperture 22 in the rotatable choke member 20 entirely out of register with the aperture 12 in the fixed choke member 10, thereby closing the flow restrictor completely. In end view, the configuration shown in FIG. 6 is similar to that shown in FIG. 4, with 0% overlap between the apertures 12, 22. The rotational choke member 20 can, of course, be rotated to any desired extent, and in either direction, allowing substantially infinite variability of the flow restrictor between 0% and 100% depending on the degree of overlap between the apertures. Optionally the extended position of the gripping devices can be maintained by valves. Optionally, the rotatable choke member 20 can be rotated in gradual increments by the shifting tool, which can grip, rotate and release before repeating the process to continue the rotation. The increments of rotation therefore do not need to be large and this simplifies the design parameters of the shifting tool. Optionally the faces of the choke members can be rotated against one another when in contact to clean debris from between the faces before, during or after choke operations.

Optionally the relative rotational positions of the choke members can be detected and optionally measured, recorded, and/or reported by a marker and a sensor located in the choke members, functioning in a similar manner to the marker and sensor discussed above with reference to the detection of the relative axial positions of the shifting tool and the choke.

Optionally the shifting tool can incorporate a torque measurement device to detect the amount of torque applied by the shifting tool to the choke and to maintain the torque applied within acceptable ranges.

Optionally a pressure differential will exist across the flow restrictor between the annulus outside of the choke and the inner bore. In certain circumstances, the pressure differential can create a force that acts to drive the choke members 10, 20 together, and in certain cases can resist rotation of the rotatable choke member 20 in order to adjust the flow restrictor, particularly when the flow restrictor is closed and there is a high pressure differential. In order to combat this, the rotatable choke member 20 optionally has first and second sealing devices 25*u* and 25*l* which have different diameters, and therefore define different sealed areas on the rotatable choke member. Optionally the surface area of the rotatable choke member 20 between the first and second sealing devices 25*u* and 25*l* which faces into the chamber is close to the maximum cross sectional area of the flow restrictor; i.e., the maximum cross-sectional area of the apertures 12, 22 (or the largest of these, if they have different cross-sectional areas) is substantially the same as the surface area of the rotatable choke member between the first and second sealing devices 25*l* and 25*u* that is exposed to pressure from the chamber 8. Optionally, the two areas are within 10% of one another, optionally 5% of one another. Within this range, force acting on the rotatable choke member 20 as a result of the pressure differential across the flow restrictor is substantially reduced or eliminated when the flow restrictor is 100% open, and this optionally applies at different pressure differentials. Therefore, the flow restrictor can optionally be subjected to different pressure differentials between the inside and the outside of the choke, without high pressure differentials forcing the rotatable choke member hard against the fixed choke member, and preventing relative rotation of the two. Accordingly, the flow restrictor can optionally be adjusted at various different pressure differentials without locking up. By virtue of the balance effect of the piston device, the force required to rotate the rotatable choke member 20 and adjust the size of the flow restrictor is therefore relatively predictable over a broad range of working pressures, and is more related to the force of the spring 28 than to the fluid pressure differentials existing across the flow restrictor. Accordingly the spring force can be kept low (e.g. 100 Nm or less) and the torque then needed to adjust the flow restrictor is then known to be a relatively predictable value above this (e.g. 200 Nm). The values here are given by way of example, and without intending limitation of the invention to these values.

In one example, a basic optional adjustment method might be as follows (after the completion string incorporating the chokes has been installed):

1. Run assembly (e.g. tractor+shifting tool+production logging tool into the hole, to the top of the production section of the well (or lateral).
2. Continue to run in while reading the tool address and rotary position of each choke as it is encountered. Record data and/or transmit as required.
3. Pull or tractor back through the zones of interest. Log tool address, rotary position, flow rate and production composition or other desired parameters for each zone. This log can provide a base line against which the intervention outcome can be judged.
4. Run assembly back to the bottom of the production section being adjusted.
5. Pull or tractor back out of the well stopping at the a tool address that requires a choke adjustment, e.g. the first or lowest choke.
6. Deploy the shifting tool to anchor the tool in position.
7. Measure choke position.
8. Deploy shifting tool to grip the rotating choke member.
9. Adjust the choke to the desired value and verify choke position, recording and/or transmitting data as required to surface.
10. De-activate both anchor and gripper.
11. Pull or tractor back out of the well stopping at another address that requires a choke adjustment, e.g. the next highest choke in the well, repeat process above.
12. When all required chokes are adjusted, stop axial movement of string.
13. Tractor back to the bottom of the well.
14. Pull or tractor back through the zones of interest. Re-log tool address, rotary position, accumulative flow rate and production composition for each zone. Repeat if necessary.
15. If the new production log shows the desired outcome, Pull Out Of Hole (POOH)
16. If further choke adjustments are required return to the zone of interest and repeat the adjustment procedure.

In the event of power loss, tool failure or a surface communication problem, both anchor and rotational grippers on the shifting tool can optionally be arranged to de-energize and retract under spring force. This is the fail-safe condition and ensures the tool package cannot become stuck in the well under its own means.

Referring now to FIGS. 7 and 8, a second choke 101 is shown having similar features to the choke 1 described with reference to FIGS. 2 to 6, and using the same reference numbers to describe such features, but increased by 100. The reader is referred to the previous description of the choke described with reference to FIGS. 2 to 6 for additional details of the structure and function of the second design of choke shown in FIGS. 7 and 8.

The second choke 101 essentially has the same structure and function as the first choke 1, and is activated by a shifting tool 150 in the same manner. Accordingly, the upper body member 105, lower body member 106, fixed choke member 110 with aperture 112, rotatable choke member 120, shifting tool 150, with anchor members 151, 156 and sensor 155 and marker 130 are all essentially the same as previously described in terms of the structure and function, and the reader is referred to the earlier description of the first choke 1 for additional details.

The second choke 101 differs from the first choke one by the means of interconnection between the shifting tool 150 and the choke 101. In the choke 101, instead of the cylinders 52, 57 having teeth or roughened radial faces in order to grip on high friction bands set on the inner surface of the choke 1, the choke 101 is provided with cylinders 152 and 157 which take the form of keys that extend radially from the anchor members 151, 156 into engagement with recesses 160, 161 on the inner surface of the choke 101. The cylinders 152, 157 are optionally actuated by hydraulic pressure, in a similar manner as described in relation to the cylinders 52, 57, but can instead in other examples of the invention being actuated by electric motors, resilient springs, or other mechanisms. Optionally, the radially outer ends of the cylinders 152, 157 have a unique fit with the recesses 160, 161, and engage with them only. Optionally, the recesses 160, 161 can comprise annular recesses.

Optionally, the cylinders 152, 157 are driven radially outwards from the chambers by means of hydraulic fluid pressure supplied through hydraulic fluid lines passing through the shifting tool 150. Optionally, the shifting tool 150 is run into position in the well with the axial distance between the cylinders 152, 157 being set at the same distance between the known axial spacing between the recesses 160, 161. Optionally, an axial telescopic joint 153 can be used to adjust the axial spacing between the two anchor members 151, 156. Optionally, the telescopic joint 153 can be adjusted by means of hydraulic power, optionally supplied by a hydraulic motor within the shifting tool. Optionally, the hydraulic motor, or the reservoir of hydraulic fluid can be supplied on another tool within the string. Optionally, the telescopic joint 153 can be adjusted by means of motive force from a different motor, for example an electric motor, and a separate motor and gearbox can optionally be provided. Optionally, the telescopic joint 153 allows relative rotation of the anchor members 151, 156. Optionally the power for driving relative rotation of the anchor members 151, 156 can be supplied from a hydraulic motor. An electric motor is also suitable, but higher torque can optionally be achieved through a supply of hydraulic fluid.

Optionally, when the shifting tool 150 is in a suitable location to adjust the flow restrictor in the choke 101, as reported by the marker and sensor, the first anchor in the form of the cylinders 152 is actuated to drive the cylinders 152 radially outward from the chambers, and into the recess 160 in order to secure the first anchor member 151 to the upper body portion 105 of the choke. After the first anchor member 151 has been secured to the choke body, the telescopic joint 153 can be extended or retracted to adjust the relative position of the first and second anchor members 151, 156, so that the cylinders 157 are in axial alignment with, and radially inside, the recess 161. Once the correct axial position has been achieved, the cylinders 157 are actuated in order to drive them radially outward, into the recess 161, to secure the second anchor member 156 onto the rotatable choke member 120. Optionally, the cylinders 152, 157 allow transfer of torque between the anchor members 151, 156. Because the inner ends of the cylinders 152, 157 only need to pass into the mouths of the recesses 160, 161, and do not need to be pressed radially into the recesses with a high forces, the tool can be engaged with the choke at relatively low radial forces.

At this point, the telescopic joint 153 between the anchor members 151, 156 is driven in rotation, by means of the hydraulic motor (or the electric or other motor) in order to rotate the rotatable choke member 120 by the desired amount to adjust the flow restriction. This can be monitored and optionally reported by marker and sensor devices in the two choke members as previously described. In the configuration shown in FIGS. 7 and 8, the rotational choke member 120 has been rotated to close the flow restrictor completely, with 0% overlap between the apertures. The rotational choke member 120 can, of course, be rotated to any desired extent, and in either direction, allowing substantially infinite variability of the flow restrictor between 0% and 100% depending on the degree of overlap between the apertures. Optionally the extended position of the gripping devices can be maintained by valves. Optionally, the rotatable choke member 120 can be rotated in gradual increments by the shifting tool, which can grip, rotate and release before repeating the process to continue the rotation.

The remaining function of the second choke 101, particularly with regard to the balance of pressure achieved by the piston device optionally provided on the rotatable choke member 120, is essentially as described in relation to the first choke 1, and the reader is referred to the specific description in relation to that example for further details of the structure and operation of the second choke 101 in this regard.

Optionally the string can incorporate power and signal lines from the surface, but in some cases, power can be provided by a downhole source, for example a battery in the string, and data can be stored in a memory on the string. A PLC (programmable logic controller) can optionally be incorporated in the string to make simple decisions based on the data collected, without surface direction or control.

Optionally the shifting tool can be arranged e.g. programmed to fail safe by disconnecting from the choke, for example by retracting the engaging devices.

Certain examples of the invention can allow the construction of chokes that have excellent compression resistance, as the choke members are optionally placed in an axial stack, with flow paths that extend axially through the choke. The resultant construction can have wide flow paths (which can themselves be increased by axial stacking) that lose little in compressive strength as the combined cross-sectional area of the flow paths increases. At the same time, the radial dimensions and concentric layers in the choke can be reduced saving radial space in the well, and allowing more radial space for flow paths in the annular area outside the choke and in the bore of the choke itself.

Certain examples allow a multi-zone, flow control system with a low installation cost while still providing the functionality of a high end system. In certain examples, the sensing, actuation and communication systems can be located in e.g. a wireline deployed shifting tool. This allows the choke design to be short in length and slim in wall thickness, thereby maintaining high internal bore capacity, with few moving parts, but still allows complex functionality at lower cost.

The invention claimed is:

1. A choke for use downhole in a subterranean well, the choke comprising:
- a conduit with a bore;
- a first opening allowing fluid communication between an outside of the conduit and the choke;
- a second opening allowing fluid communication between the choke and the bore of the conduit;
- a flow path connecting the first and second openings; and
- a flow restrictor that is selectively adjustable to change a cross sectional area of the flow path through the choke, the flow restrictor comprising first and second choke members, each incorporating a portion of the flow path;
- wherein at least one of the first and second choke members is rotatable relative to the other to change the cross sectional area of the flow path;

wherein the at least one choke member is rotated by a shifting tool which is lowered into the bore of the conduit after the choke has been installed in the subterranean well; and wherein the flow path through the choke members has a portion with an axial component, relative to a longitudinal axis of the bore of the conduit.

2. The choke according to claim 1, wherein the portion with the axial component is spaced radially from the bore of the conduit.

3. The choke according to claim 1, wherein the portion with the axial component is parallel to the axis of the bore of the conduit.

4. The choke according to claim 1, wherein the flow restrictor is located in the axial portion, and at least a part of the flow path through the flow restrictor is parallel to the axis of the bore of the conduit.

5. The choke according to claim 1, wherein the first choke member has a first mating face that engages a cooperating second mating face of the second choke member, and wherein the first mating face has at least one aperture that moves relative to at least one aperture on the second mating face as the at least one choke member rotates relative to the other choke member.

6. The choke according to claim 1, wherein the choke includes a flow path that changes a direction of fluid flowing through the flow path through 90 degrees between the openings.

7. The choke according to claim 1, wherein fluid flowing axially in an annulus between the choke and an inner surface of a surrounding wellbore flows into an axially facing inlet, and wherein the flow path through the choke gradually changes through 90 degrees to be generally perpendicular to the axis of the bore of the conduit when the fluid reaches the second opening.

8. A method of controlling flow of fluid in a subterranean well, comprising:

providing a choke to control the flow of fluid between a reservoir and a bore of a conduit in the well, the choke comprising:

a first opening allowing fluid communication between an outside of the conduit and the choke;

a second opening allowing fluid communication between the choke and the bore of the conduit; and a flow path connecting the first and second openings, the flow path incorporating a flow restrictor that is selectively adjustable to change a cross sectional area of the flow path through the choke, wherein the flow restrictor comprises first and second choke members, each of the choke members incorporating a portion of the flow path, wherein at least one of the first and second choke members is rotatable relative to the other to change the cross sectional area of the flow path through the choke, and wherein the at least one choke member is rotated by a shifting tool which is lowered into the bore of the conduit after the choke has been installed in the subterranean well; and controlling the flow of fluid in the well by rotating the at least one choke member relative to the other choke member.

9. The method according to claim 8, wherein the first choke member has a first mating face that engages a cooperating second mating face of the second choke member, and wherein the first mating face has at least one aperture that moves relative to at least one aperture on the second mating face as the at least one choke member rotates relative to the other choke member.

10. A flow control assembly for use in a subterranean well, the flow control assembly comprising:

a screen; and a choke having a flow restrictor that is selectively adjustable to change a cross sectional area of a flow path through the choke, and wherein the cross sectional area of the flow path through the choke is adjustable downhole via a shifting tool which is lowered into the choke after the choke has been installed in the subterranean well to vary a flow of fluid between the screen and the choke, and the shifting tool is operative to rotate a first choke member of the flow restrictor relative to a second choke member of the flow restrictor to vary the cross sectional area of the flow path through the choke.

11. The flow control assembly according to claim 10, wherein the choke is axially spaced from the screen in the flow control assembly.

12. The flow control assembly according to claim 10, wherein components of the choke overlap radially with components of the screen.

13. The flow control assembly according to claim 10, wherein the cross-sectional area of the flow path through the choke can be adjusted from the surface while the screen is in the well.

14. The flow control assembly according to claim 10, wherein the screen comprises a multi-layer screen having more than one layer of filter material, each layer of filter material being adapted to resist passage of particulates through the screen.

15. The flow control assembly according to claim 14, wherein different layers of filter material have different pore sizes which are adapted to resist passage of different sizes of particulates.

16. The flow control assembly according to claim 10, wherein wellbore conditions selected from the group consisting of fluid density, fluid flow rate, fluid viscosity, and fluid temperature in the bore of the well are measured and recorded, or transmitted to a surface of the earth for recording and analysis, by a logging tool when the flow control assembly is in place in the well.

* * * * *